United States Patent [19]

Steinkamp

[11] 4,014,546

[45] Mar. 29, 1977

[54] SCORING APPARATUS

[76] Inventor: Jeffrey H. Steinkamp, 1225 Maine St., Quincy, Ill. 62301

[22] Filed: May 29, 1975

[21] Appl. No.: 581,776

[52] U.S. Cl. ..... 273/102.2 S; 273/102.1 C

[51] Int. Cl.[2] ..... A63B 67/00

[58] Field of Search ..... 272/4; 45/8 A; 273/101.1, 101.2, 102.1 C, 102.1 R, 102.2 R, 102.2 S, 102.2 A, 102.1 B

[56] References Cited

UNITED STATES PATENTS

| | | | |
|---|---|---|---|
| 2,695,173 | 11/1954 | Sterne | 273/102.2 R |
| 2,743,929 | 5/1956 | Smith | 273/102.2 R |
| 2,767,987 | 10/1956 | Klose | 273/102.2 R |
| 2,767,987 | 10/1956 | Klose | 273/102.2 A |
| 2,818,560 | 12/1957 | Edrich | 273/102.2 R |
| 2,890,052 | 6/1959 | Burrell | 273/102.2 R |
| 3,101,198 | 8/1963 | Williams | 273/102.2 R |
| 3,304,612 | 2/1967 | Proctor | 273/102.2 R |
| 3,454,276 | 7/1969 | Brenkert | 273/102.2 R |
| 3,511,506 | 5/1970 | Schollick | 273/179 |
| 3,522,398 | 7/1970 | Heimann | 272/4 |
| 3,605,285 | 9/1971 | Bendaniel | 35/8 A |
| 3,677,546 | 7/1972 | Oetiker | 273/102.2 R |
| 3,707,699 | 12/1972 | Sanctuary | 273/102.2 S |
| 3,729,197 | 4/1973 | Swanson | 273/102.2 R |
| 3,790,173 | 2/1974 | Callaway | 273/102 B |
| 3,893,256 | 7/1975 | Wolf | 46/1 R |

*Primary Examiner*—Richard C. Pinkham
*Assistant Examiner*—Vance Y. Hum
*Attorney, Agent, or Firm*—Craig & Antonelli

[57] ABSTRACT

A scoring apparatus includes a pad upon which a parachutist impacts, containing normally separated and electrically insulated conductive sheets. A fish net type of insulator disposed between the sheets permits contact therebetween upon impact by a jumper. A voltage representative of the point of contact of the jumper upon the pad is thereby generated and supplied to a display device which displays the accuracy of the landing upon the pad.

5 Claims, 7 Drawing Figures

SCORING APPARATUS

FIELD OF THE INVENTION

The present invention relates to a scoring apparatus, particularly one employed for measuring and displaying the landing position of a parachutist.

BACKGROUND OF THE INVENTION

The determination of the landing position of a parachutist, relative to an intended target, has been conventionally carried out by a human judge, whose function it is to identify and mark the first point of contact of the parachutist, usually with a long spike, and then measure the distance between the center of a prescribed target and the point of placement of the marking spike. This linear distance is measured typically with a measuring tape and the accuracy of the jump of the parachutist is determined by the measured distance.

However, because of human subjective judgment and the sequential actions of implanting the spike and measuring the distance from the center of a target's bullseye, the possibility of considerable error exists in determining the accuracy of the jump of the parachutist.

The present invention has been developed to obviate such errors and, moreover, to provide a system which automatically generates a remote digital read-out indicative of the accuracy of the parachutist relative to the center of an intended target, so that the jumper will be presented with a true and unbiased record of his jumping ability.

BRIEF DESCRIPTION OF THE INVENTION

In accordance with the present invention, a scoring pad, which may be of generally circular shape, is placed at the intended target area. The scoring pad itself contains a set of electrically insulated conductive components which are adapted to come into contact with one another in response to an impact by the jumper. By virtue of the layout of the components within the scoring pad itself, the position of impact of the jumper, relative to a prescribed point on the scoring pad, is determined and an electrical output signal representative of this position is supplied to a remote indicator. The indicator is calibrated to indicate the initial point of impact of the jumper.

The scoring pad and the system of evaluation associated therewith may be digital or analog and the shape of the scoring pad may take on any desired geometrical configuration as is desired in accordance with the target measurement employed.

DETAILED DESCRIPTION

Figure 1:
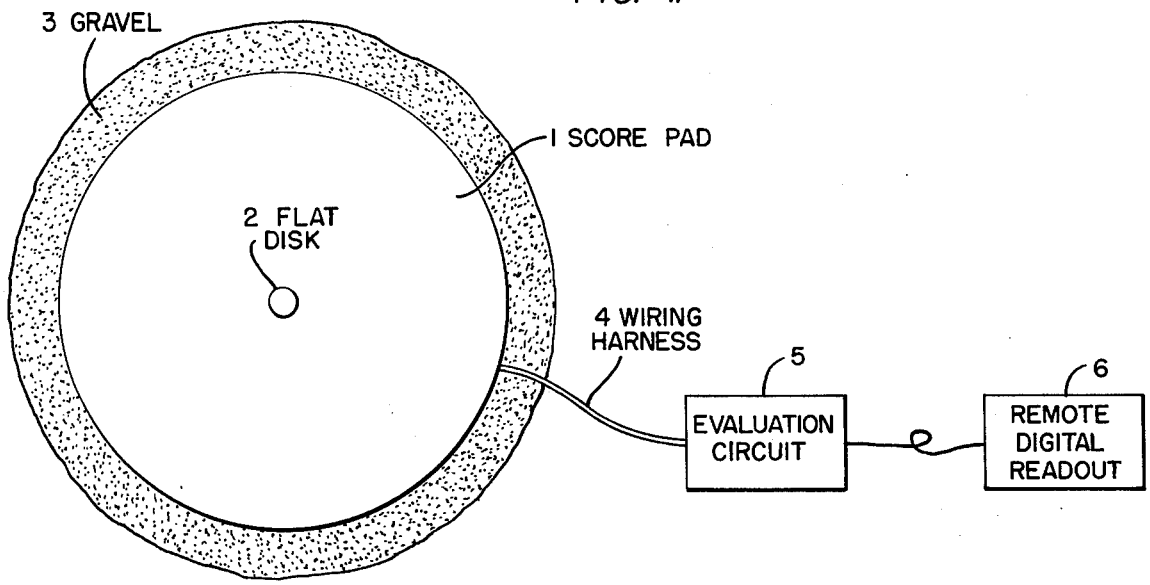
FIG. 1 is an overall plan view of the basic scoring system in accordance with the present invention.
Figure 2:
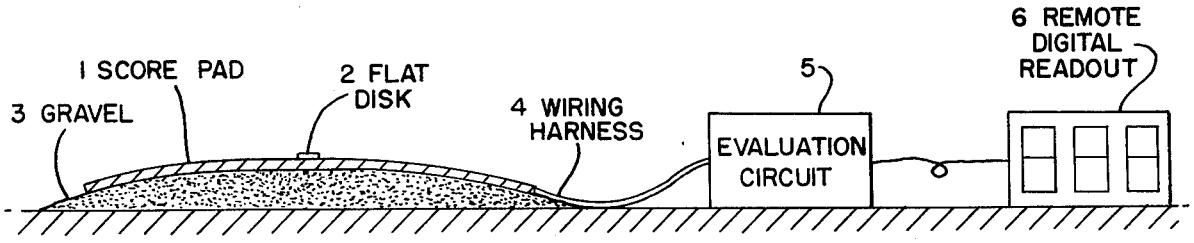
FIG. 2 is a side elevation view of the scoring system shown in FIG. 1.

As is shown in FIGS. 1 and 2, a circularly shaped score pad 1, having a flat central disc 2, is disposed on a gravel bed 3. The internal electrical components of the score pad 1 are connected by way of a wiring harness 4 to an evaluation circuit 5. The output of the evaluation circuit is supplied to a remote digital read out 6, which indicates the accuracy of the impact by the jumper, i.e. how close the jumper is to the central flat disc 2 of the score pad 1. The score pad 1 and the evaluation circuitry associated therewith may be designed for either digital or analog modes of operation.

DIGITAL MODE

Figure 3:
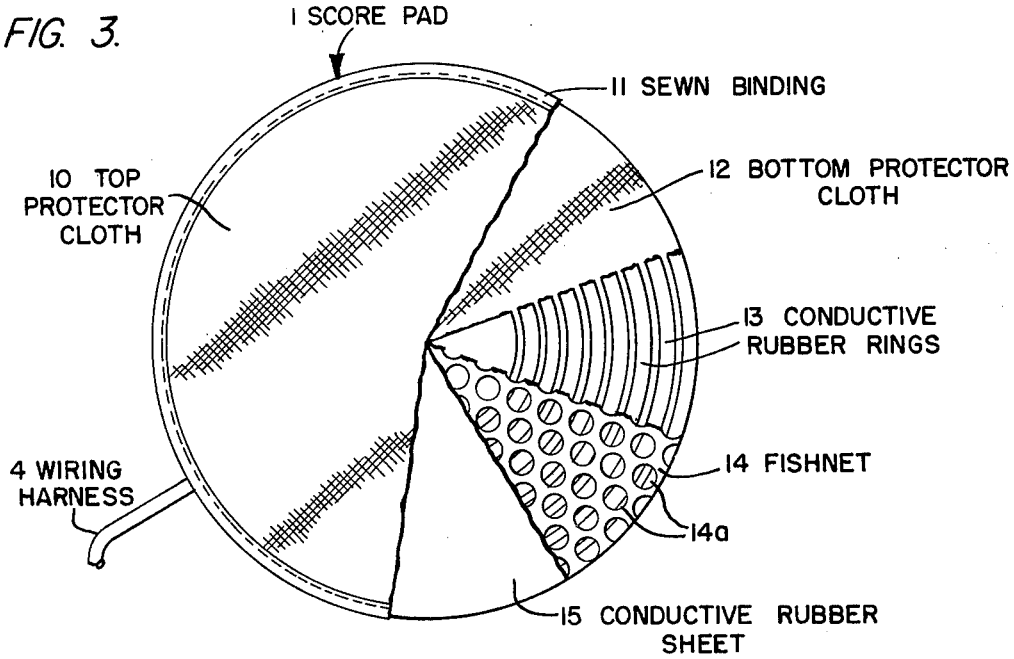
FIG. 3 shows the constituent components of the score pad employed in one embodiment of the invention.

In the digital mode of the invention, the score pad 1 has the configuration shown in FIG. 3.

The top and bottom of the score pad are made of sections of protective cloth 10 and 11, which are sewn together along the circumference of the pad by binding 11. Adjacent the bottom protector cloth 12 is a set of conductive rubber rings 13, concentrically disposed about the center of the pad. A fish net 14 separates and insulates the conductive rubber rings 13 from a continuous conductive rubber sheet 15, which is disposed adjacent the top protector cloth. A set of wires within harness 4 is connected to the set of rings 13 while an additional wire is connected to the sheet 15 and supplies a potential of +12 volts thereto from a battery in the external circuitry. By virtue of the protector cloths and the sewn binding, the internal components made up of the conductive rings and the conductive rubber sheet, separated by the fish net, are rendered weatherproof. The pliability of the rubber rings and the rubber sheet, as well as the fish net material, makes the pad elastically deformable so that it is both flexible and durable.

Figure 4:
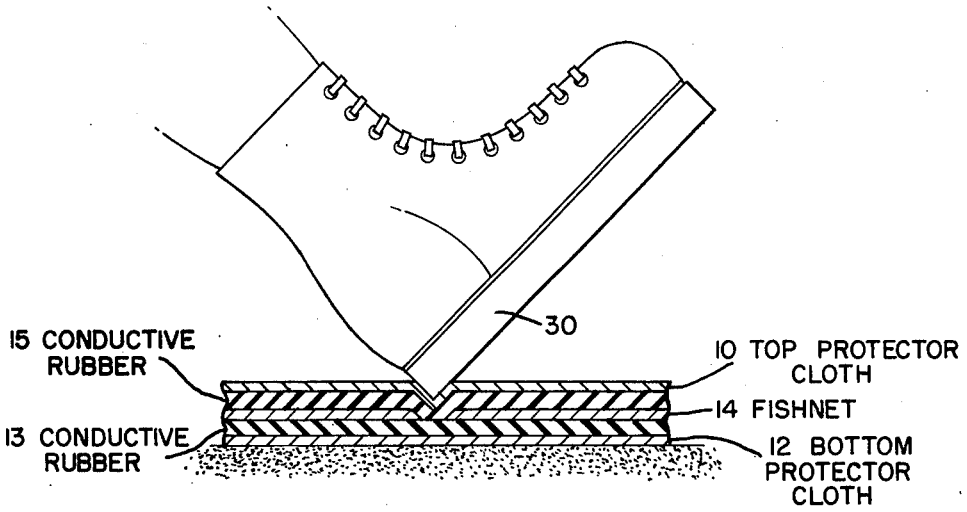
FIG. 4 illustrates the mechanical deformation of the score pad in response to the impact of a jumper.

Due to the concentric ring arrangement of the conductive rubber rings 13, the internal structure of the pad is, in effect, a circular-shaped type of keyboard. For a better understanding of what happens when a parachutist impacts on the score pad, attention is directed to FIG. 4, which shows a boot 30 depressing the top protector cloth 10, the conductive rubber sheet 15 and the fish net 14.

When the jumper impacts upon the pad, the weight of his boot 30 depresses the top of the pad, so that conductive rubber sheet 15 will be forced through the holes 14*a* in the fish net 14 to cause both mechanical and electrical contact between the upper conductive rubber sheet 15 and a lower conductive ring 13. This contact now provides a connection from the +12 volt battery through the conductive rubber sheet 15 and the appropriate ring 13 through the electrical wiring in the wiring harness 4 to the evaluation circuit 5. Each of the conductive rings 13 is insulated from the other rings and is connected through its own separate wire to an encoder contained within the evaluation circuit 5.

Figure 5:
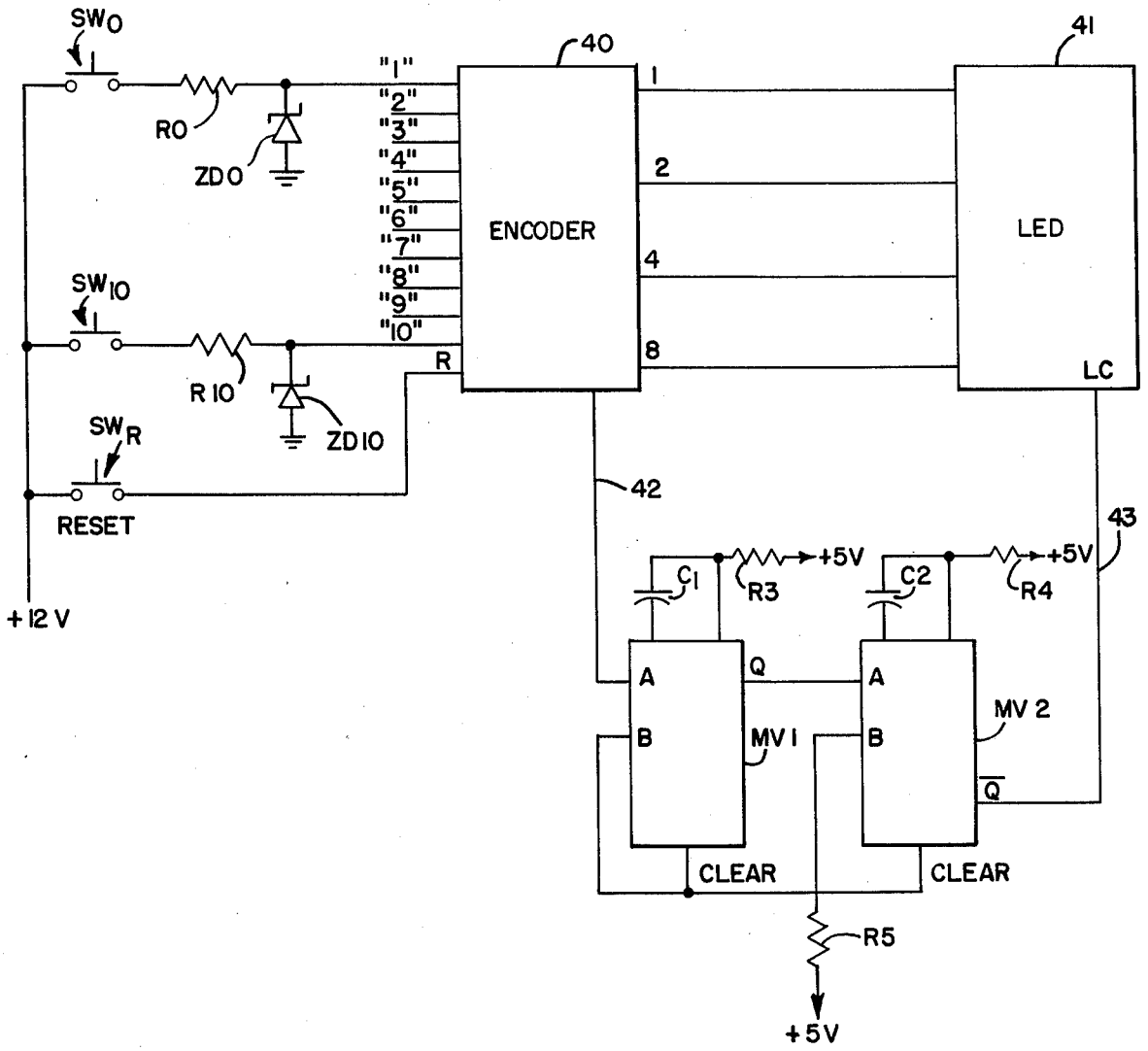
FIG. 5 is a schematic diagram of the digital evaluation circuitry which may be employed in accordance with the present invention.

The details of the evaluation circuit are shown in FIG. 5, wherein switches SW0-SW10 schematically illustrate the contacting operation of the conductive rubber sheet 15 with the respective rings 13. While the rings need not be concentric and may take on any desired shape in accordance with the target structure intended, and the number of rings is not limited, for explanatory purposes, it has been assumed that there are ten rings contained within the set of rings 13, as shown by the input line designations "1" – "10". At the center of the conductive rubber ring set 13 is a circular disc which corresponds to the switch SW0, and represents a direct bullseye hit. In other words, if the jumper hits the center of the ring, the distance from the center of the ring would necessarily be zero, so that the jumper would receive a score of 0 corresponding to the distance from the center of the ring. The radial scores increase outwardly from the edge of the bullseye and are measured in appropriate units depending upon the size of the conductive rings in the set 13.

Now, upon impact, when the conductive rubber sheet 15 passes through the fish net 14 to contact an appropriate rubber ring 13, and thereby supply +12 volts to the encoder 40 over an appropriate one of the input lines "0" – "10", the voltage is coupled at a respective resistor-Zener diode combination, such as R0-ZD0 to the encoder 40. The resistor-Zener diode combination protects the input of the encoder 40 from an overvoltage.

The encoder 40 encodes a decimal input as a binary-coded-decimal output over the appropriate binary lines 1, 2, 4 and 8 to a light emitting diode device 41. The light emitting diode device provides an appropriate numerical display representative of the decimal value of the binary coded decimal inputs on the lines, 1, 2, 4 and 8, as encoded by the encoder 40.

Thus, assuming that the point of impact of the parachutist was at the location of the sixth conductive rubber ring in the set 13, an input would be supplied to the sixth input of the encoder 40 and the 2 and 4 outputs thereof would supply signals to the light emitting diode display 41 to cause a 6 to be illuminated. Connected between the encoder 40 and the light emitting display device 41 is a set of multivibrators MV1 and MV2 which permit only a single score to be evaluated and locked into the system at a time. This assures that the first point of contact with the score pad is the only point of contact which is evaluated and displayed.

The encoder 40, while being connected to a plurality of input lines "0" to "10", has a preference for the lowest input supplied thereto, so that it will encode the lowest input if more than one ring is simultaneously activated. Thus, if the jumper impacts upon fifth and sixth rings simultaneously, the encoder will encode only the five input and supply outputs over the 1 and 4 lines to the light emitting display device 41. At the same time, an output is supplied from the encoder 40 over line 42 to the A input of the multivibrator MV1 to trigger the same which, in turn, triggers the A input of multivibrator MV2. With the multivibrator MV2 being triggered, the potential level at the Q output changes, to supply a high level over the line 43 to the latch strobe input LC of the light emitting device 41. When the LC input of the light emitting display device 41 is high, the data within the latch circuitry of the device is held constant and is unaffected by new data inputs on the lines 1, 2, 4, and 8 from the encoder 40. This ensures that the numerical read-out of the first point of impact of the jumper can be maintained until the system is reset.

To reset the circuit, switch $SW_R$ is depressed to clear the encoder 40 and multivibrators MV1 and MV2 are reset to permit the light emitting display device 41 to receive new data. The evaluation circuit is now ready to score a new impact upon the pad 1.

Each of the components shown in the above circuit diagram of FIG. 5 is commercially available. For example, the encoder 40 may be a HD-0165 keyboard encoder manufactured by Harris Semiconductor, the light emitting diode display device 41 may be a numeric display with logic type device TIL 308 manufactured by Texas Instruments Incorporated and the multivibrators may be retriggerable monostable multivibrators with clear inputs, type N 74123 manufactured by Signetics Corporation.

ANALOG MODE

Figure 6:
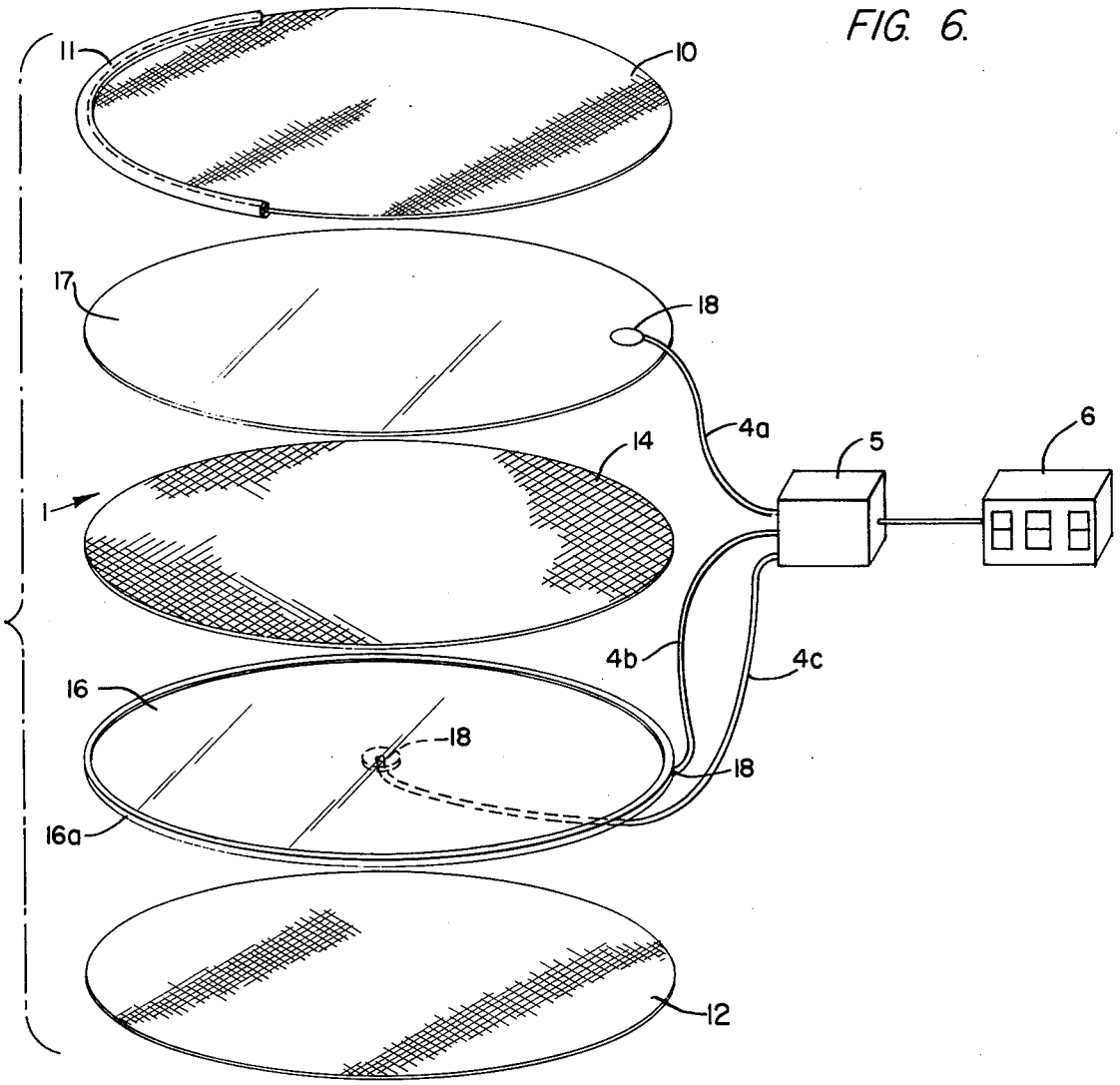
FIG. 6 is an exploded view of the score pad employed in the analog embodiment of the present invention.
Figure 7:
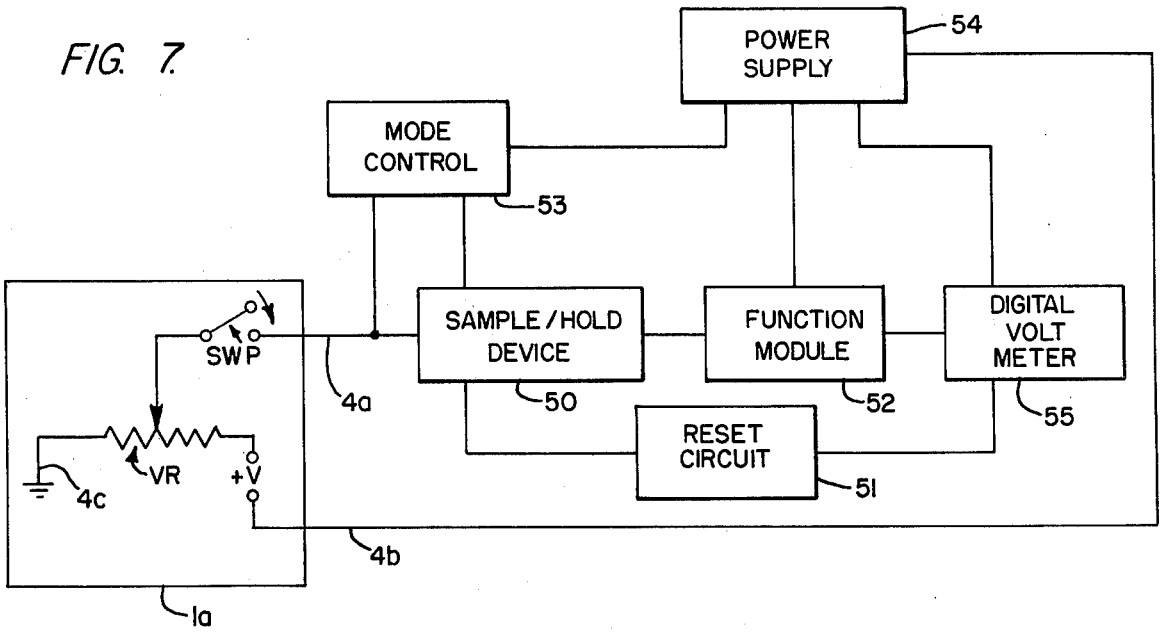
FIG. 7 is a schematic diagram of the analog evaluation circuitry which may be employed in accordance with the present invention.

The analog mode of the invention is illustrated in FIGS. 6 and 7. In FIG. 6, the score pad 1 is shown as having the same top and bottom protective cloths 10 and 12, and the sewn binding 11 as in the digital embodiment. In place of the ring arrangement shown in FIG. 3, however, a pair of sheets 16 and 17 are disposed on opposite sides of a fish net 14. Sheet 16 is made of partially conductive rubber, the resistivity of which is 8 ohm-cm and has a ring of conductive paint **16*a* disposed along its circumference, about 0.5 centimeters wide. The upper sheet 17 may be made of the same partially conductive rubber of which sheet 16 is made, or it may be a sheet of conductive rubber as in the digital embodiment. At the center portion of the lower sheet 16, conductive wire 4*c* is soldered to a copper tape pad 18. Additional wires 4*a* and 4*b* are also connected to respective pads 18 on sheets 17 and 16, respectively. If sheet 17 is only partially conductive, then pad 18 attached thereto is centrally located. However, if sheet 17 is a good conductor, then pad 18 may be disposed any where on the sheet. The wires 4*a*, 4*b* and 4*c* are contained within the wiring harness 4 (shown in FIGS. 1 and 2) and are connected to the evaluation circuit 5. A voltage (+10V) is applied through wire 4*b* to the conductive paint ring 16*a* on the lower sheet 16 and ground potential is supplied through the wire 4*c* to the pad 18 centrally located on the lower semiconductive sheet 16. By virtue of the potential difference between lines 4*b* and 4*c*, a potential gradient is established across the sheet 16 between the respective pads 18. This voltage gradient increases exponentially from ground at the center of the pad to the +10V potential supplied over line 4*b*** at the edge of the pad.

Now, when the jumper comes in contact with the score pad 1, the depression of the upper sheet 10 will force the sheet 17 through the fish net 14 into contact with the sheet 16. As a result, a voltage which lies between the reference potentials on lines **4*b* and 4*c* will be supplied over line 4*a* to the evaluation circuit 5**.

Contained within the evaluation circuit is a power supply 54, a mode control circuit 53, a sample/hold device 50, a function module 52, a digital volt meter 55 and a reset circuit 51, connected as shown in FIG. 7.

In effect, the score pad of the analog embodiment acts as a tapped resistor, shown in FIG. 7 as variable resistor VR, the tap of which is connected through a switch SWP, representative of the impact of the jumper upon the scorepad 1.

The voltage generated at the point of input is supplied from the pad **1*a* over line 4*a* to the sample/hold device 50 which stores the voltage representative of the first point of contact. This voltage is then converted in the function module 52 to a voltage representative of the linear distance between the center of the pad and the point of impact. For this purpose, a conventional logarithmic converter circuit whose output is proportional to the logarithm of the input may be employed for module 52, in order to convert the exponential voltage input to a linear voltage output. The digital volt meter 55 is calibrated in terms of distance so that its input voltage will be representative of the distance between the point of impact and the center of the pad. Digital volt meter 55 preferably employs a light emitting diode display representation of the input voltage. The system is reset by a reset circuit 51, which may consist of a push-button switch which clears the sample/hold device. For example, if a conventional capacitor is used for the a sample/hold device, the capacitor is discharged and the digital volt meter is reset. As was the case with the digital embodiment, each of the components shown in FIG. 7** is commercially available.

While the foregoing embodiments have described the use of a circular-shape score pad upon which a parachutist impacts, the present invention is, however, not limited merely to parachuting sport events, but may be employed in other sports, where measurements from a point of reference location to a point of impact are carried out. For example, it may be employed in track and field events, such as the shotput, discus throw, long jump, etc. For these events the shape of the score pad is preferably pie-shaped, the pad extending radially from the toss or throw ring. Of course, the same components in the respective digital or analog modes described previously for a circular pad are employed for a pie-shaped pad.

While I have shown and described several embodiments in accordance with the present invention, it is understood that the same is not limited thereto but is susceptible of numerous changes and modifications as known to a person skilled in the art and I, therefore, do not wish to be limited to the details shown and described herein but intend to cover all such changes and modifications as are obvious to one of ordinary skill in the art.

I claim:

1. A scoring apparatus comprising:

an elastically deformable target structure upon which an object is to impact, said target structure containing first and second spaced-apart members, each of which is made of pliable material, normally physically separated from one another in the absence of the impact of an object by a net-like sheet of pliable insulator material, capable of supporting said spaced-apart members relative to each other in the absence of the impact of an object while permitting said spaced-apart members to elastically deform and come into physical and electrical contact with one another upon impact by an object on either of said members of pliable material; and means, connected to said spaced-apart members, for generating an electrical signal representative of the position on said target structure upon which an object impacts and thereby causes physical and electrical contact between said spaced-apart members; and wherein said first member is a sheet of pliable material which is at least partially conductive, said second member is a pliable sheet of partially conductive material, and said means comprises a first source of reference potential connected to a first selected location on said pliable sheet of partially conductive material, a second source of reference potential connected to a second selected location spaced-apart from said first selected location on said pliable sheet of partially conductive material, thereby establishing a voltage gradient across said second member between said first and second spaced-apart locations, a conductor connected to said pliable sheet of at least partially conductive material, and voltage conversion circuit means, connected to said conductor, for storing a voltage lying within said gradient supplied to said conductor in response to the impact of an object on said target structure and for converting said stored voltage to an electrical output representative of the distance between the position of impact of said object and one of said first and second selected locations on said pliable sheet of partially conductive material.

2. A scoring apparatus according to claim 1, wherein said sheet of at least partially conductive material is a sheet of conductive material.

3. A scoring apparatus according to claim 1, wherein said first member is only partially conductive.

4. A scoring apparatus according to claim 1, wherein said pliable sheet of partially conductive material includes a strip of conductive film passing through one of said first and second selected locations, one of said first and second sources of reference potential being connected to said strip of conductive film.

5. A scoring apparatus according to claim 1, further including means, coupled to said electrical signal generating means, for controllably providing an indication only of the position on said target structure upon which an object initially impacts, irrespective of any subsequent impact on said target structure by an object.

* * * * *